US006940483B2

(12) United States Patent
Maeda et al.

(10) Patent No.: US 6,940,483 B2
(45) Date of Patent: Sep. 6, 2005

(54) METHOD FOR DRIVING DISPLAY DEVICE HAVING DIGITAL MEMORY FOR EACH PIXEL

(75) Inventors: Takashi Maeda, Saitama-ken (JP); Takanori Tsunashima, Saitama-ken (JP); Hiroyuki Kimura, Saitama-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 295 days.

(21) Appl. No.: 10/325,937

(22) Filed: Dec. 23, 2002

(65) Prior Publication Data

US 2003/0174116 A1 Sep. 18, 2003

(30) Foreign Application Priority Data

Dec. 26, 2001 (JP) ..... P 2001-394201

(51) Int. Cl.[7] ..... G09G 3/36
(52) U.S. Cl. ..... 345/98; 345/90
(58) Field of Search ..... 345/87–104

(56) References Cited

U.S. PATENT DOCUMENTS 5,712,652 A * 1/1998 Sato et al. ..... 345/90
5,798,746 A * 8/1998 Koyama ..... 345/98
5,945,972 A * 8/1999 Okumura et al. ..... 345/98
6,064,362 A * 5/2000 Brownlow et al. ..... 345/98
6,115,017 A * 9/2000 Mikami et al. ..... 345/92
6,331,844 B1 * 12/2001 Okumura et al. ..... 345/87
6,771,247 B2 * 8/2004 Sato et al. ..... 345/98
6,778,162 B2 * 8/2004 Kimura et al. ..... 345/90

FOREIGN PATENT DOCUMENTS

JP 2001-264814 9/2001

* cited by examiner

*Primary Examiner*—Xiao Wu
(74) *Attorney, Agent, or Firm*—Oblon, Spivak, McClelland, Maier & Neustadt, P.C.

(57) ABSTRACT

During a still picture display period, a normal write voltage is sometimes unable to be applied to a liquid crystal layer 16 because two memory switch elements 21 and 22 are simultaneously turned on, and the output and the inverted output from the digital memory 18 are applied simultaneously to a pixel electrode 13. According to the present invention, the pulse width for the on period of one of the memory switch elements 21 and 22 is narrower than the pulse width for the off period of the other memory switch element, so that the on periods of the two memory switch elements 21 and 22 do not overlap. In this manner, the memory switch elements 21 and 22 are prevented from being turned on at the same time.

5 Claims, 5 Drawing Sheets

METHOD FOR DRIVING DISPLAY DEVICE HAVING DIGITAL MEMORY FOR EACH PIXEL

CROSS-REFERENCE TO RELATED APPLICATIONS

This application is based upon and claims the benefit of priority from Japanese Patent Application No. 2001-394201 filed Dec. 26, 2001; the entire contents of which are incorporated herein by reference.

BACKGROUND OF THE INVENTION

1. Field of the Invention

The present invention relates to a method for driving a high quality, low power consumption display device, including a digital memory for each pixel and intended for use with small information terminals.

2. Description of Related Art

In recent years, liquid crystal display devices have commonly been used in small information terminals, such as portable telephones or electronic notebooks, because they are light, thin, and have low power consumption. Further, since the small information terminals are generally battery operated, reducing power consumption is a matter of great importance.

Especially with regards to portable telephones, there is a need for devices that can display data in a standby mode at low power consumption. As one example of a technique adapted to realize these needs, a liquid crystal display device is disclosed in Japanese Unexamined Patent Publication No. 2001-264814. During a standby period (hereinafter referred to as a still picture display period), this liquid crystal display device, which includes a digital memory for each pixel, achieves a dramatic reduction in power consumption by halting all peripheral driver circuits other than an alternating-current driver circuit that supplies an alternating current for driving the liquid crystal.

Since in this liquid crystal display device the liquid crystal is driven by an alternating current when a still picture is displayed, two memory switch elements are provided on the output side of the digital memory. When, in accordance with two independent memory control signals, these memory switch elements are alternately turned on for each frame, the output/inverted output (binary output) of the digital memory are alternately applied to a pixel electrode, and in accordance with this cycle the potential of the opposite electrode is inverted. Therefore, for a pixel for which the phase of the potential of the pixel electrode corresponds to that of the potential of the opposite electrode, no voltage is applied to the liquid crystal layer, while for a pixel for which the phase of the potential of the pixel electrode is the inverse of that of the potential of the opposite electrode, a voltage is applied to the liquid crystal layer. By repeating this operation, the liquid crystal can be driven by an alternating current.

However, since a wiring resistor and a wiring capacitor exist along a memory control signal line over which the memory control signals are transmitted, the rise time and fall time of the memory control signal waveform may be delayed. Due to this delay when the two memory switch elements are turned on at the same time, the output and inverted output of the digital memory are applied to the pixel electrode at the same time, therefore a normal write voltage is unable to be applied to the liquid crystal layer, and a still picture display failure occurs.

SUMMARY OF THE INVENTION

1. As a feature of the present invention, there is provided a method for driving a liquid crystal display device having: an array substrate wherein each cell of a matrix delimited by scan lines and signal lines includes a pixel electrode, a pixel switch element for electrically connecting the pixel electrode and the signal line, a digital memory in which video data supplied by the signal line is stored and from which the video data can be extracted both as output and as inverted output, two memory switch elements for electrically connecting the pixel electrode and the digital memory; an opposite substrate including an opposite electrode that faces the pixel electrodes; a display layer sandwiched between the array substrate and the opposite substrate; the method comprising the steps of: turning off the two memory switch elements so as to electrically disconnect the pixel electrode and the digital memory, and turning on the pixel switch element so as to write the video data to the pixel electrode during a normal display period; turning off the pixel switch element to electrically disconnect the signal line and the pixel electrode, alternately turning on the two memory switch elements so as not to cause the overlapping of the on periods of the two memory switch elements, and extracting the video data from the digital memory as output or inverted output alternately, writing the video data to the pixel electrode during a still picture display period.

DETAILED DESCRIPTION OF EMBODIMENT

An explanation will now be given for one embodiment wherein a method for driving a liquid crystal display device according to the present invention is employed for an active matrix liquid crystal display device having a digital memory for each pixel. In this embodiment, video data for a normal display used for half tone and moving pictures is called moving picture data, and binary video data for a still picture display used for black or white is called still picture data. The moving picture data and the still picture data are both labeled under a generic name of video data.

Figure 1:
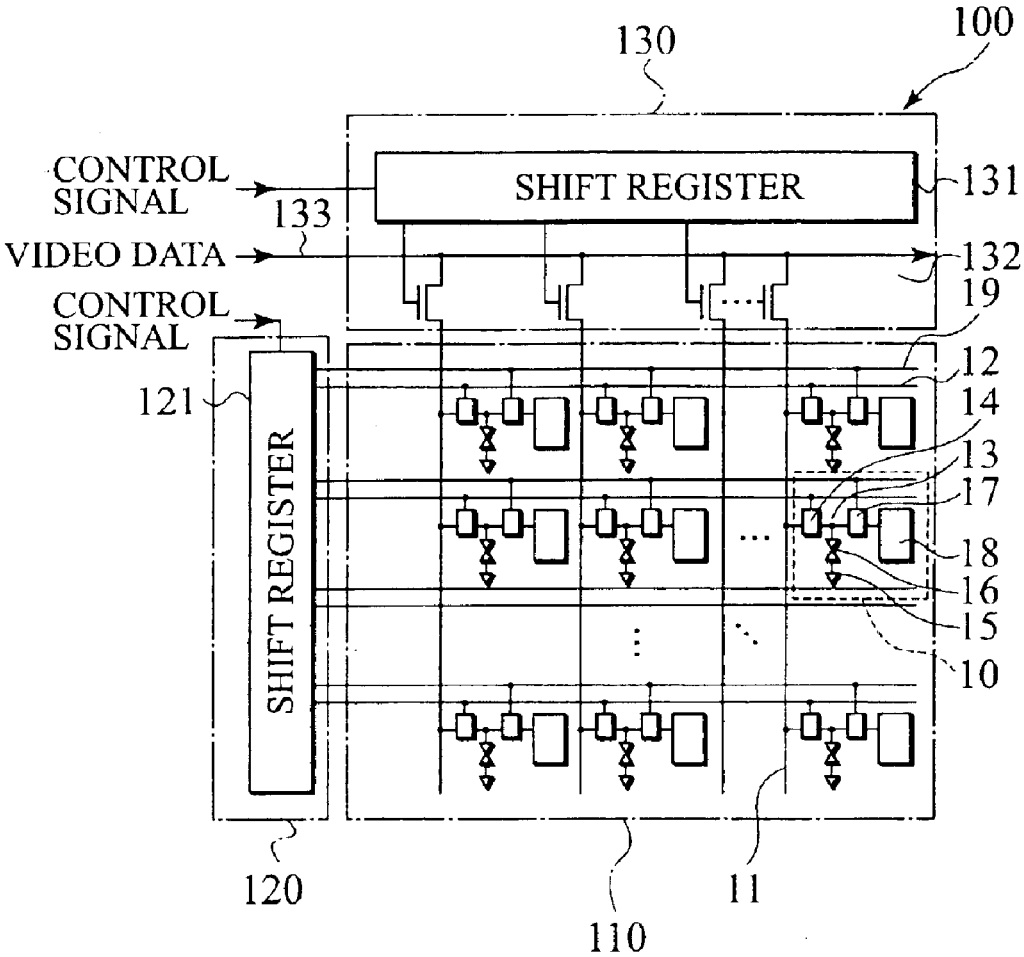
FIG. 1 is a circuit diagram showing the configuration of an active matrix liquid crystal display device according to one embodiment of the present invention.

As shown in the circuit diagram of FIG. 1, a liquid crystal display device 100 comprises a display section 110, wherein a plurality of pixels 10 are formed; a scan line driver circuit 120; and a signal line driver circuit 130.

The scan line driver circuit 120 and the signal line driver circuit 130 are integrally formed on an array substrate 101 shown in the cross-sectional view of FIG. 2, with signal lines 11, scan lines 12 and pixel electrodes 13, which will be described later. The scan line driver circuit 120 and the signal line driver circuit 130 may be arranged on an external drive substrate (not shown).

In the display section 110, the signal lines 11 and the scan lines 12 are arranged on the array substrate 101 so that they intersect to describe a matrix within which the display pixels 10 are formed as individual matrix cells.

Each of the display pixels 10 includes a pixel electrode 13, a pixel switch element 14, an opposite electrode 15, a liquid crystal layer 16, a digital memory switch circuit (hereinafter referred to as a DM switch circuit) 17 and a digital memory 18.

In the display pixel 10, the pixel switch element 14 is connected respectively by a source connected to the signal line 11, a gate connected to the scan line 12, and a drain connected to the pixel electrode 13. The pixel electrode 13 is further connected to the digital memory 18 through the DM switch circuit 17, wherein a gate of the DM switch circuit 17 is connected to the memory control line 19, a source thereof is connected to the pixel electrode 13, and the drain thereof is connected to the digital memory 18.

An auxiliary capacitor (not shown) is electrically connected in parallel to the pixel electrode 13, and as is described later, two memory control signal lines, 19*a* and 19*b*, are arranged in each cell. To simplify the explanation, in FIG. 1 only one memory control signal line 19 is shown.

Figure 2:
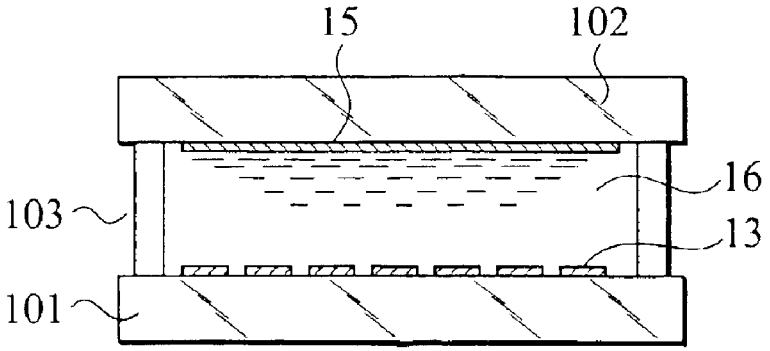
FIG. 2 is a schematic cross-sectional view of the liquid crystal display device in FIG. 1.

As shown in FIG. 2, all the pixel electrodes 13 are formed on the array substrate 101, and a common opposite electrode 15, which faces the pixel electrodes 13, is formed on an opposite substrate 102. A predetermined opposite potential is applied to the opposite electrode 15 by a control IC arranged on an external drive substrate (not shown), and a liquid crystal layer 16 is supported as a display layer between the pixel electrodes 13 and the opposite electrode 15, while a sealing material 103 seals the periphery of the array substrate 101 and the opposite substrate 102. An alignment layer and a polarize plate are not shown in FIG. 2.

The scan line driver circuit 120 includes a shift register 121 and a buffer circuit (not shown). Based on a Y clock signal (a vertical clock signal) and a Y start signal (a vertical start signal), received as a control signal from an external driver circuit (not shown), the scan line driver circuit 120 outputs a scan signal to all of the scan lines 12 for each horizontal scan period. In accordance with the scan signal, the scan line 12 is switched to the on level, and all the pixel switch elements 14 connected to this scan line 12 are turned on.

The scan line driver circuit 120 outputs the scan signal and sequentially turns on the scan lines 12 for a normal half tone or moving picture display (hereinafter referred to as a normal display), or turns off all the scan lines 12 for a still picture display. Furthermore, the scan line driver circuit 120 transmits a memory control signal to the memory control signal line 19 for turning on or off the DM switch circuit 17 in accordance with the timing for the display period. In this embodiment, the level of the memory control signal line 19 is off for a normal display, and is on or off for a still picture display. Furthermore, a memory control signal may be transmitted directly to the memory signal line 19 by an external driver circuit (not shown), without passing through the scan line driver circuit 120.

The signal line driver circuit 130 includes a shift register 131 and analog switches 132. The signal line driver circuit 130 receives an X clock signal (a horizontal clock signal) and an X start signal (a horizontal start signal) as control signals from a control IC (not shown), and also receives video data from the control IC over a video bus 133. Based on the X clock signal and the X start signal, the shift register 131 transmits an on or off signal to the analog switches 132 to sample the video data received from the video bus 133 and transmit the video data to the signal lines 11.

The operation for a normal display will be described briefly. When the scan line driver circuit 120 outputs a scan signal and sequentially turns on the scan lines 12 for each horizontal scan period, all the pixel switch elements 14 connected to the scan lines 12 at the on level are turned on. Then in synchronization with this operation the moving picture data is sampled to the signal line 11, the sampled data is written to the pixel electrodes 13 through the pixel switch elements 14. The moving picture data is charged as a write voltage between the pixel electrode 13 and the opposite electrode 15 (and an auxiliary capacitor (not shown)), whereby the liquid crystal layer 16 responds in accordance with the amount of the write voltage, the amount of light transmitted by each display pixel 10 is controlled. This writing process is performed for all the scan lines 12 during one frame period, and the video for one screen is completed.

Figure 3:
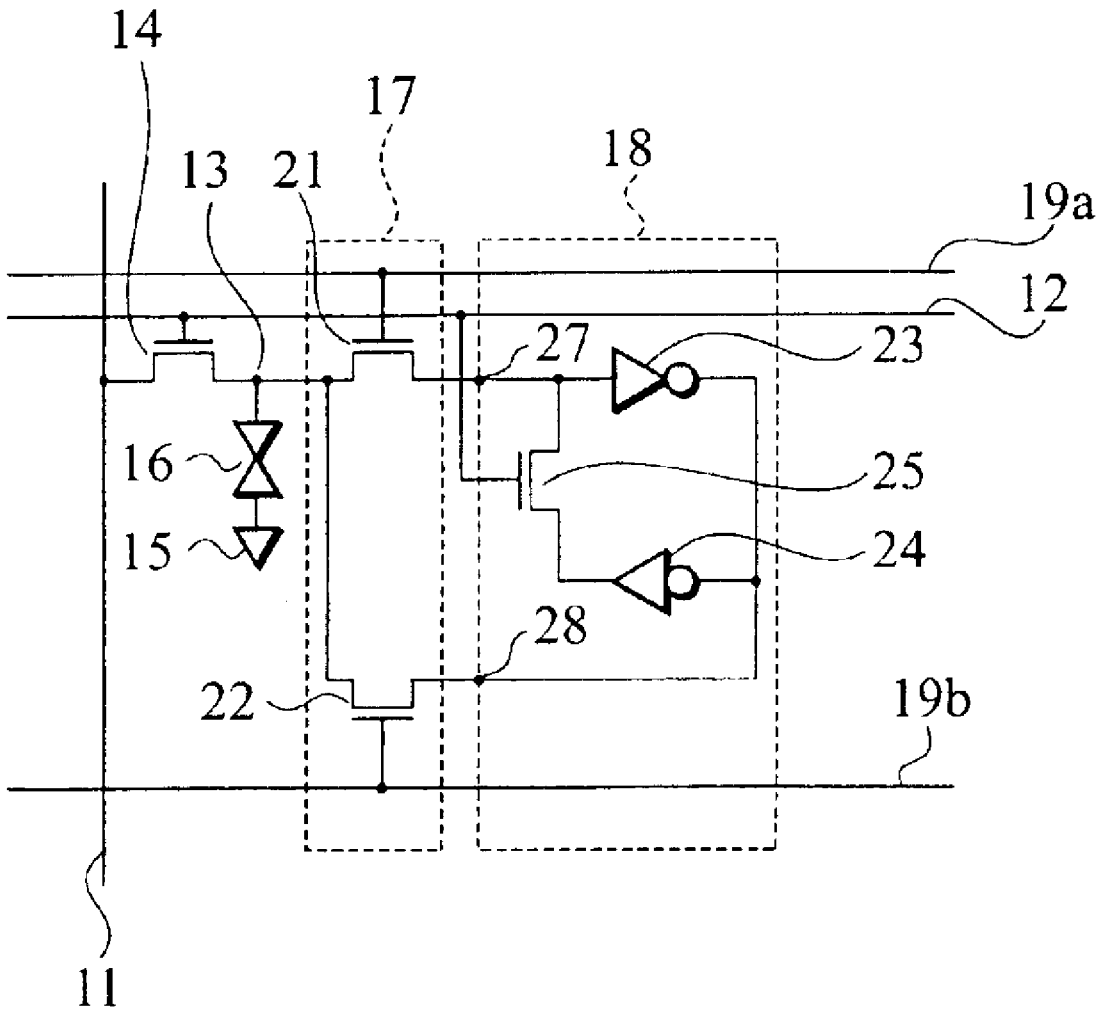
FIG. 3 is a circuit diagram showing the structure of a display pixel of the liquid crystal display device in FIG. 1.
Figure 4:
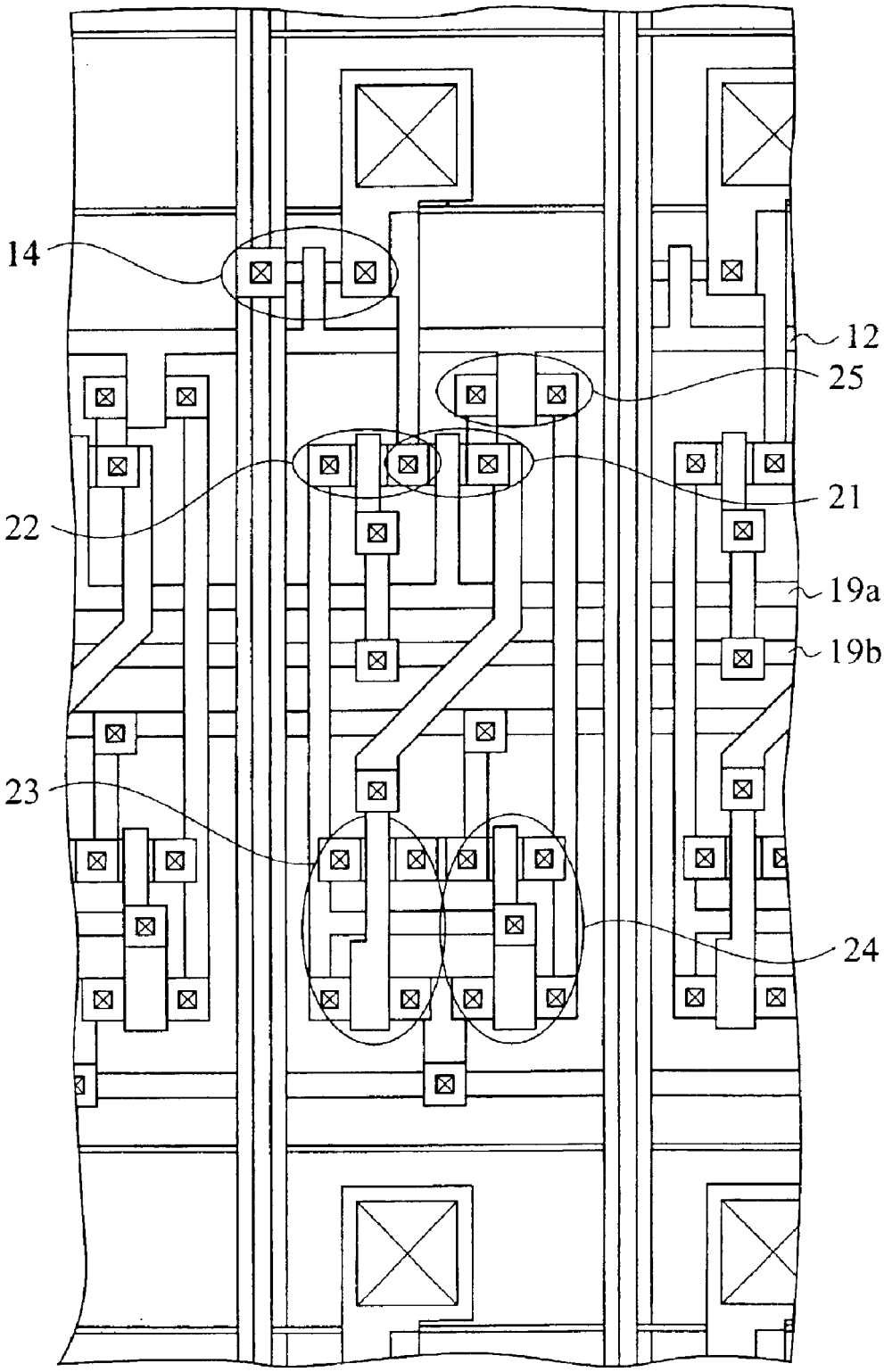
FIG. 4 is a plan view of the schematic structure of the display pixel in FIG. 3.

The circuit structure of the display pixel 10 in this embodiment will be explained with reference to the circuit diagram of FIG. 3 and the plan view of FIG. 4.

The DM switch circuit 17 includes two memory switch elements 21 and 22, and is inserted between output terminals 27 and 28 of the digital memory 18 and the pixel electrode 13. In the DM switch circuit 17, the gate of the memory switch element 21 is connected to the memory control signal line 19*a*, and the gate of the memory switch element 22 is connected to the memory control signal line 19*b*. The memory switch elements 21 and 22 are independently controlled by the scan line driver circuit 120 transmitting memory control signals to the memory control signal lines 19*a* and 19*b*.

During the still picture display period, memory control signals are transmitted to the memory control signal lines 19*a* and 19*b* so that they are alternately turned on in every frame. At this time, the pulse width for each memory control signal is set so that the on periods for the memory switch elements 21 and 22 do not overlap. The pulse width for the on period of one of memory control signals is set to be narrower than the pulse width for the off period of the other memory control signal. Specifically, the rise portion and the fall portion of the pulse width for the on period are cut, so that the pulse width is narrower than the pulse width for the off period that is, at least, the equivalent of the rise time and the fall time imposed by the time constants for the memory control signals.

The digital memory 18 includes two inverters 23 and 24 and a switch element 25. The switch element 25 is the polar channel of the pixel switch element 14, where both of the pixel switch element 14 and the switch element 25 are constituted by CMOS transistor. The gate of the switch element 25 is connected to the same scan line 12, as that to which the gate of the pixel switch element 14 is connected, and when the scan signal is transmitted to this scan line 12, the pixel element switch 14 and the switch element 25 are turned on or off at the same time. It should be noted, however, that the on/off states of the pixel switch element 14 and the switch element 25 have an inverse relation to each other. In other words, when the pixel switch element 14 is turned on, the switch element 25 is turned off, while when the pixel switch element 14 is turned off, the switch element 25 is turned on.

A positive power line and a negative power line (neither shown) are respectively connected to the positive sides and the negative sides of the inverters 23 and 24, a high power voltage and a low power voltage are supplied by a power circuit (not shown). In a still picture writing frame, which will be described later, when a write voltage for the still picture data received from the output terminal 27 of the digital memory 18 corresponds to a black display, for example, the high power voltage is maintained at the output side of the inverter 23 and the low power voltage is maintained at the output side of the inverter 24. Whereas, when a write voltage for the still picture data corresponds to a white display, for example, the low power voltage is maintained at the output side of the inverter 23 and the high power voltage is maintained at the output side of the inverter 24.

Figure 5:
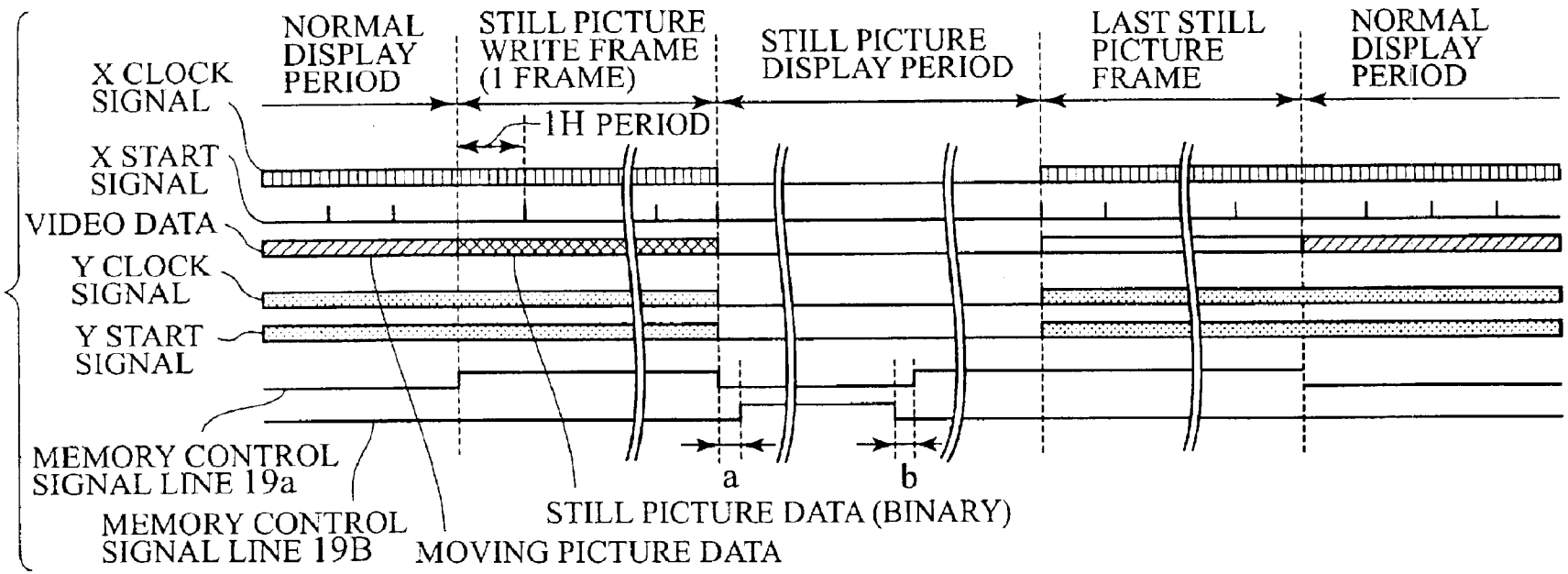
FIG. 5 is a timing chart for a signal waveform indicating the operation of the liquid crystal display device in FIG. 1.

The operation of the thus arranged liquid crystal display device 100 will also be described with reference to the timing chart of FIG. 5.

During a normal display period, the memory control signal lines 19*a* and 19*b* are at the off level, and the two memory switch elements 21 and 22 are turned off so as to electrically disconnect the pixel electrode 13 and the digital memory 18. Then, during a predetermined cycle, the pixel switch element 14 is turned on, and video data received over the signal line 11 is written to the pixel electrode 13 to display a picture. That is, during the normal display period, the Y clock signal and the Y start signal are transmitted to the scan line driver circuit 120, while the X clock signal, the X start signal and moving picture data are transmitted to the signal line driver circuit 130, and a full-color, half tone/moving picture display is provided. In FIG. 5, the 1H period represents a single horizontal scan period, and a scan signal is output by the scan line driver circuit 120, which is synchronized with the X start signal to be output for each 1H period.

To switch from the normal display to the still picture display, during the still picture writing frame wherein the normal display is shifted to the still picture display, the memory control signal line 19*a* is set to the on level and the memory control signal line 19*b* is set to the off level. Then, during the period wherein the pixel switch element 14 is turned on by the scan signal, the still picture data is sampled by the analog switch 132 and written to the digital memory 18 through the signal line 11, the pixel switch element 14, and the memory switch element 21.

After the still picture data has been written to the digital memory 18, the scan line 12 is set to the off level while the pixel switch element 14 is turned off and the switch element 25 is turned on. As a result, the inverters 23 and 24 are connected in a loop. The power voltage at each of the output sides of the inverters 23 and 24 is maintained in this loop.

During the succeeding still picture display period, the pixel switch element 14 is turned off so as to electrically disconnect the signal line 11 and the pixel electrode 13. Following this, the memory control signal line 19*a* is set to the off level and the memory control signal line 19*b* is set to the on level, the still picture data stored in the digital memory 18 is output through the output terminal 27, and is written to the pixel electrode 13 through the memory switch element 21. During the still picture display period, the transmission of a control signal and video data by the control IC (not shown) to the scan line driver circuit 120 and the signal line driver circuit 130 is halted.

During the still picture display period, the still picture data written to the pixel electrode 13 can be maintained for only a short period of time, but when the still picture data is maintained for an extended period of time, deterioration of the state of the liquid crystal layer 16 would occur due to a direct current component. Thus, alternating-current drive is required even within a still picture display period. In this embodiment a still picture display period is implemented by alternately setting the memory control signal lines 19*a* and 19*b* to the on level at one frame intervals, alternatively turning on the memory switch elements 21 and 22 so as not to cause overlapping of the on periods of the two memory switch elements 21 and 22, extracting the still picture data in the digital memory 18 as output or inverted output alternatively, writing the still picture data to the pixel electrodes 13, and inverting the potential of the opposite electrode 15 in accordance with the intervals.

That is, when the memory switch elements 21 and 22 are alternately turned on, the high or low potentials of the pixel electrodes 13 are alternately output, and when the high or low potentials of the opposite electrode 15 are synchronously switched, while no voltage is applied to the liquid crystal layer 16 of the display pixel 10 having the same polarity as that of the opposite electrode 15, a voltage is applied to the liquid crystal layer 16 of the display pixel 10 having the opposite polarity. Thus, a black or a white binary display can be provided.

As previously described, to prevent the overlapping of the on periods of the memory switch elements 21 and 22, the memory control signals transmitted to the memory control signal lines 19*a* and 19*b* are set so that the pulse width for the on period of one of the memory switch elements 21 and 22 is narrower than the pulse width for the off period of the other memory switch element. In the example shown in FIG. 5, the rising portion and the falling portion of the memory control signal supplied to the memory control signal line 19*b* are cut by lengths (a and b) equivalent to the rising time and falling time due to the time constant of the memory control signal line 19*b*, so that the pulse width for the on period of the memory control signal line 19*b* is narrower than the pulse width for the off period of the memory control signal line 19*a*.

The pulse width for the on period of the memory control signal supplied to the memory control signal line 19*a* may be narrower than the pulse width for the off period of the memory control signal supplied to the memory control signal line 19*b*. Furthermore, the pulse widths for the on periods of these two memory control signals may be narrower than the pulse widths for the off periods of these signals respectively. So long as the pulse width for the on period for one of the memory control signals is narrower, the on periods of the memory control signals will not overlap. The potential of the opposite electrode 15 is inverted at one frame cycle, and it is preferable that a voltage be applied to the opposite electrode 15 during a period equivalent to the pulse width of the on period of the memory control signal.

To switch from the still picture display to the normal display, after the display of the last still picture frame has been completed, the memory control signal lines 19*a* and 19*b* are again set to the off level. The X and Y clock signals, the start signals, and the moving picture data are respectively transmitted to the scan line driver circuit 120 and the signal line driver circuit 130. The last still picture frame corresponds to a preparation period set for shifting from the still picture display to the normal display. During this preparation period, although the writing of video data is not performed, the scan line driver circuit 120 and the signal line driver circuit 130 are restarted.

Therefore, according to the above described drive method, even when the rise time and fall time of the memory control signals are delayed during the switching of the display for each frame in the still picture display period, the on periods of the memory switch elements 21 and 22, which extract still picture data from the digital memory 18, do not overlap, and the memory switch elements 21 and 22 are not turned on at the same time. Thus, the output and inverted output of the digital memory 18 are not transmitted to the pixel electrode 13 at the same time, and a normal write voltage can always be applied to the liquid crystal layer 16. As a result, a superior display quality can be obtained for the still picture display.

In addition, since within the still picture display period only the memory control signal lines 19 and the opposite electrode 15, both of which are driven at a low frequency, are operated in the display section 110, a multi-colored, low power consumption display can be provided during the still picture display period.

Since a backlight is not required when a light-reflecting pixel electrode composed of a thin metal film is employed as the pixel electrode 13, the driving power required for this configuration is even lower than that required for a light-transmitting configuration when a backlight is used. When an experiment was conducted in which a still picture was displayed on a 5 cm diagonal, 250,000 pixels liquid crystal panel at a frame frequency 60 Hz, it was possible to reduce the power consumption to 5 mW.

A method for manufacturing the liquid crystal display device 100 will be described with reference to FIGS. 6A to 6F.

In FIGS. 6A to 6F, the display section 110 is shown on the right along a broken line, and a driver section (the scan line driver circuit 120 and the signal line driver circuit 130) is shown on the left. The steps in the manufacturing process will be described in order from FIG. 6A to 6F.

Figure 6:
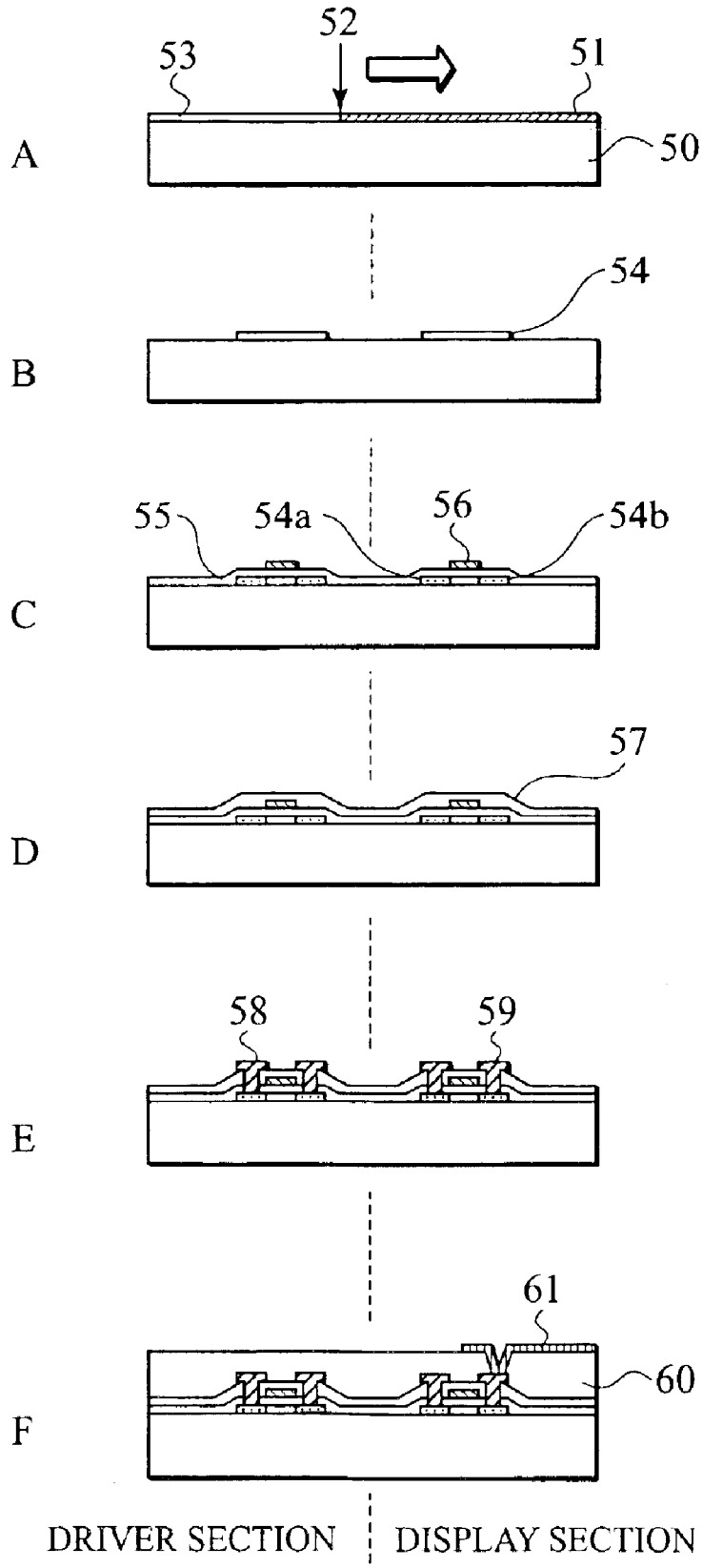
FIGS. 6A to 6F are schematic cross-sectional views of a process for the manufacture of the liquid crystal display device in FIG. 1.

FIG. 6A: A thin, 50 nm thick amorphous silicon (a-Si) film 51 is deposited on a transparent insulating substrate 50 such as glass by using the plasma CVD method. The a-Si film 51 is annealed to obtain a polycrystalline film by using XeCl excimer laser device (not shown). During this process, a laser beam 52, emitted by the XeCl excimer laser device, scans the substrate 50 in the direction indicated by an arrow in FIG. 6A, and the region irradiated by the laser beam 52 is crystallized and forms a polycrystalline silicon film 53. At this time, since the amorphous silicon film is irradiated multiple times, as the laser irradiation energy increases gradually, hydrogen can be effectively removed from the film, and abrasion during the crystallization process is prevented. The irradiation energy is 200 to 500 mJ/cm$^2$.

FIG. 6B: Photolithography is used to pattern the polycrystalline silicon film 53 and to form an active layer 54 for thin film transistors.

FIG. 6C: A gate insulating film 55, which is a silicon oxide film, is formed using the plasma CVD method, and then a molybdenum-tungsten alloy film is deposited by sputtering and is patterned to form a gate electrode 56. During this patterning process, the scan lines are also formed. A silicon nitride film or a silicon oxide film formed by using an atmospheric CVD method may also be employed as the gate insulating film 55.

By using the gate electrode 56 as a mask, an ion doping method is employed to inject impurities into the active layer 54, and also drain regions 54*a* and source regions 54*b* for thin film transistors are formed. As the impurities, phosphorus can be used for an n-channel transistor, and boron can be used for a p-channel transistor. And by employing an LDD (Lightly Doped Drain) structure for transistors in the display section, it is possible to effectively suppress current leakage when the transistors are at the off level. In this case, after impurities have been injected into the active layer 54, the gate electrode 56 is once again patterned to remove only specific portions, and an impurity is again injected at a low density.

FIG. 6D: A first inter-layer insulating film 57, which is an oxide silicon film, is formed on the gate insulating film 55, on which the gate electrode 56 is formed, using the plasma CVD method or the atmospheric CVD method.

FIG. 6E: Contact holes communicating with a drain region 54*a* and a source region 54*b* are formed in the first inter-layer insulating film 57 and the gate insulating film 55. Then, an Al film that covers the contact holes is deposited by sputtering, and is patterned to form a drain electrode 58 and a source electrode 59. Signal lines are also formed at this time.

FIG. 6F: A low dielectric insulating film (a second inter-layer insulating film) 60 is formed on the first inter-layer insulating film 57 on which the drain electrode 58 and the source electrode 59 are formed. The low dielectric insulating film 60 can be formed by using such as a silicon nitride film formed using the plasma CVD method, a silicon oxide film, or an organic insulating film. A contact hole communicating with the source electrode 59 is formed in the low dielectric insulating film 60, and a thin Al film 61 is deposited over the contact hole and is patterned to form a pixel electrode.

Through this processing, the display section 110 and the driver section can be integrally formed on the transparent insulating substrate 50. The formed array substrate 101 and the opposite substrate 102, whereon the opposite electrode 15 is formed, are arranged so as to face each other, and the sealing material 103, composed of an epoxy resin, hermetically seals their outer edges. The resultant structure is filled by the injection of a liquid crystal composition, and sealed. Then the liquid crystal display device is completed (see FIG. 2).

Since the electron mobility coefficient of polysilicon (p-Si) TFT is greater by two digits than the mobility coefficient of a-Si TFT, the TFT size can be reduced, and peripheral drivers can be integrally formed on the transparent insulating substrate 50. Further, to increase the operating speed and to reduce power consumption, it is preferable that the peripheral drivers have a CMOS structure. Therefore, as the impurity doping process in FIG. 6C, two processes, a P-type impurity doping process and an N-type impurity doping process, may be performed using a resist mask.

What is claimed is:

1. A method for driving a liquid crystal display device having:

an array substrate wherein each cell of a matrix delimited by scan lines and signal lines includes a pixel electrode, a pixel switch element for electrically connecting the pixel electrode and the signal line, a digital memory in which video data supplied by the signal line is stored and from which the video data can be extracted both as output and as inverted output, two memory switch elements for electrically connecting the pixel electrode and the digital memory;

an opposite substrate including an opposite electrode that faces the pixel electrodes;

a display layer sandwiched between the array substrate and the opposite substrate; the method comprising the steps of:

turning off the two memory switch elements so as to electrically disconnect the pixel electrode and the digital memory, and turning on the pixel switch element so as to write the video data to the pixel electrode during a normal display period;

turning off the pixel switch element to electrically disconnect the signal line and the pixel electrode, alternately turning on the two memory switch elements so as not to cause the overlapping of the on periods of the two memory switch elements, and extracting the video data from the digital memory as output or inverted output alternately, writing the video data to the pixel electrode during a still picture display period, wherein a pulse width for the on period for one of the memory switch elements is narrower than a pulse width for the off period of the other memory switch element.

2. A method according to claim 1, wherein the pulse width for the on period is narrower than the pulse width for the off period by a length that is at least the equivalent of the rise time and the fall time due to a time constant to a memory control signal line which provides a memory control signal to the memory switch element.

3. A method according to claim 1, wherein the potential of the opposite electrode is inverted in synchronization with predetermined intervals at which the two memory switch elements are alternately turned on.

4. A method according to claim 3, wherein a voltage is applied to the opposite electrode during a period equivalent to the pulse width for the on period of the memory switch element.

5. A method according to any one of claims 1, 2, 3, or 4, wherein the video data stored in the digital memory comprises a write voltage corresponding to a black or a white display.

* * * * *